US011550238B2

(12) United States Patent
Kitagawa et al.

(10) Patent No.: US 11,550,238 B2
(45) Date of Patent: Jan. 10, 2023

(54) DEVELOPING DEVICE AND IMAGE FORMING APPARATUS INCLUDING SAME

(71) Applicant: KYOCERA Document Solutions Inc., Osaka (JP)

(72) Inventors: Hiroaki Kitagawa, Osaka (JP); Rei Yamagishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/701,495

(22) Filed: Mar. 22, 2022

(65) Prior Publication Data

US 2022/0342342 A1 Oct. 27, 2022

(30) Foreign Application Priority Data

Apr. 27, 2021 (JP) ..... JP2021-074705

(51) Int. Cl.
*G03G 15/08* (2006.01)

(52) U.S. Cl.
CPC ..... *G03G 15/0817* (2013.01); *G03G 15/0812* (2013.01); *G03G 15/0881* (2013.01); *G03G 15/0898* (2013.01); *G03G 2215/0866* (2013.01)

(58) Field of Classification Search
CPC ..... G03G 15/0812; G03G 15/0817; G03G 15/0881; G03G 15/0898; G03G 2215/0866
See application file for complete search history.

(56) References Cited

U.S. PATENT DOCUMENTS

2010/0092206 A1* 4/2010 Matsushita ..... G03G 15/0898 399/103
2014/0178093 A1* 6/2014 Nishiwaki ..... G03G 15/0817 399/103
2016/0282754 A1* 9/2016 Kuramoto ..... G03G 15/0812

FOREIGN PATENT DOCUMENTS

JP 2015-11230 A 1/2015

* cited by examiner

*Primary Examiner* — Joseph S Wong
(74) *Attorney, Agent, or Firm* — Stein IP, LLC

(57) ABSTRACT

A developing device includes a development casing, a developer carrying member, and a regulating blade. The development casing has an opening part. The developer carrying member has a developing area. The development casing has a blade facing part. The regulating blade includes a fixed part and a regulating part, and a space between the regulating part and the blade facing part is larger than a space between the fixed part and the blade facing part. The developing device further includes a blade seal member. The blade seal member is disposed between the regulating blade and the blade facing part, and is glued to an upstream side surface of the regulating part in the rotation direction, so as to seal a gap between the regulating blade and the blade facing part.

8 Claims, 7 Drawing Sheets

DEVELOPING DEVICE AND IMAGE FORMING APPARATUS INCLUDING SAME

INCORPORATION BY REFERENCE

This application is based upon and claims the benefit of priority from the corresponding Japanese Patent Application No. 2021-074705 filed Apr. 27, 2021, the entire contents of which are hereby incorporated by reference.

BACKGROUND

The present disclosure relates to a developing device and an image forming apparatus including the same.

An image forming apparatus using an electrophotographic method, such as a copier, a printer, a facsimile, a multifunction peripheral thereof, or the like, includes a developing device for developing an electrostatic latent image formed on an outer circumference surface of an image carrying member, i.e., for forming a toner image (developer image) as a visualized image of the electrostatic latent image.

The developing device includes a development casing and a developer carrying member. The development casing accommodates developer containing toner. The development casing has a case opening part that opens on a downstream side of the development casing in a movement direction in the image forming apparatus when the developing device is attached to the image forming apparatus. The developer carrying member is disposed in contact with or near the image carrying member. The developer carrying member carries the developer (toner) in the development casing on the outer circumference surface.

The developer carrying member is disposed to overlap the case opening part. A part of the developer carrying member is exposed to outside of the developing device through the case opening part. The exposed part from the case opening part of the developer carrying member faces the image carrying member so that a developing area is formed. The developing area is an area for supplying the image carrying member with the toner in the development casing.

As such the developing device, there is one having a regulating blade disposed on an upstream side of the developing area in a rotation direction of the developer carrying member. The entire area of the regulating blade along a rotation axis direction of the developer carrying member protrudes toward the outer circumference surface of the developer. A distal edge of the regulating blade contacts with or is close to the outer circumference surface of the developer carrying member. The regulating blade regulates a layer thickness of the developer carried by the developer carrying member.

The regulating blade is constituted of a fixed part and a regulating part that are formed as separate members. The fixed part is a part fixed to the development casing. The regulating part regulates a layer thickness of the developer on the developer carrying member. The fixed part and the regulating part are bonded to each other to be unified by welding, adhesive, or the like. In order to increase stiffness or strength of the fixed part, the fixed part has a larger thickness than the regulating part. Therefore, a stepped shape is formed at the fixed part and the regulating part, and a space between the fixed part and the development casing is smaller than a space between the regulating part and the development casing.

In such the developing device, a blade seal member is disposed between the regulating blade and the development casing. The blade seal member seals a gap between the regulating blade and the development casing so as to prevent the developer from leaking.

SUMMARY

A developing device according to one aspect of the present disclosure includes a development casing, a developer carrying member, and a regulating blade. The development casing has an opening part and accommodates developer containing toner. The developer carrying member is supported by the development casing in a rotatable manner, and has a developing area in which a part of an outer circumference surface for carrying the developer is exposed through the opening part and faces an image carrying member, so as to supply the toner to the image carrying member in the developing area. The regulating blade is disposed on an upstream side of the developing area in a rotation direction of the developer carrying member, so as to regulate a layer thickness of the developer carried by the developer carrying member. The development casing has a blade facing part that faces an upstream side surface of the regulating blade in the rotation direction. The regulating blade includes a fixed part that faces the blade facing part and is fixed to the development casing, and a regulating part that protrudes from the fixed part toward the developer carrying member. A space between the regulating part and the blade facing part is larger than a space between the fixed part and the blade facing part. The developing device further includes a blade seal member. The blade seal member is disposed between the regulating blade and the blade facing part, and is glued to an upstream side surface of the regulating part in the rotation direction, so as to seal a gap between the regulating blade and the blade facing part.

DETAILED DESCRIPTION

Figure 1:
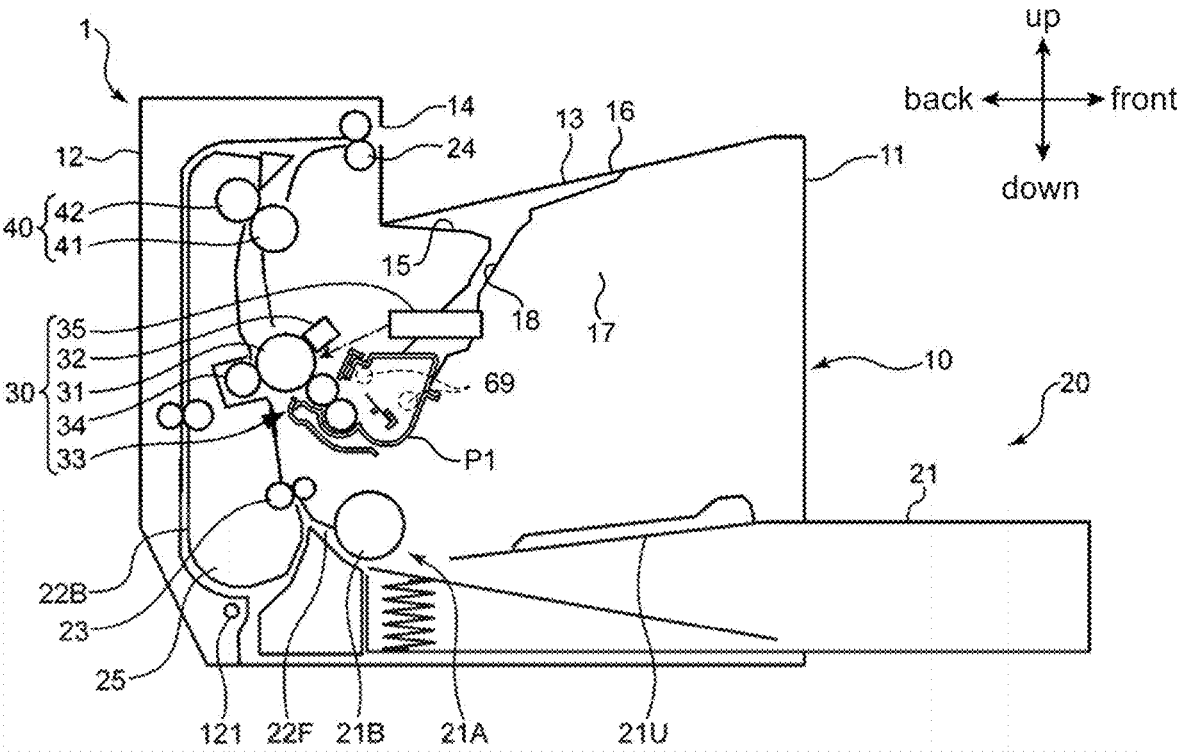
FIG. 1 is a cross-sectional side view illustrating a schematic structure of an image forming apparatus of the present disclosure.

Hereinafter, with reference to the drawings, an embodiment of the present disclosure is described. FIG. 1 is a cross-sectional side view illustrating a schematic structure of an image forming apparatus 1 of the present disclosure. Note that the right side in FIG. 1 is a front side of the image forming apparatus 1, and the left side in FIG. 1 is a back side of the image forming apparatus 1. In addition, the upper side in FIG. 1 is an upper side of the image forming apparatus 1, and the lower side in FIG. 1 is a lower side of the image forming apparatus 1.

As illustrated in FIG. 1, the image forming apparatus 1 (e.g. a monochrome printer) includes a main body housing 10 (apparatus main body), a paper teed unit 20, an image forming unit 30, a developing device 33, and a fixing unit 40. The main body housing 10 has a housing structure of a substantially rectangular parallelepiped shape. The paper feed unit 20 is housed in the main body housing 10.

The main body housing 10 includes a front cover 11, a back cover 12, a main body opening part 15, and an upper cover 16. The front cover 11 is positioned on a front side of the main body housing 10. The back cover 12 is positioned on a back side of the main body housing 10. The main body opening part 15 is formed at an upper part of the main body housing 10. The upper cover 16 is disposed on an upper surface of the main body housing 10. The upper cover 16 can open and close the main body opening part 15. By opening the upper cover 16, the inside of the main body housing 10 can be accessed through the main body opening part 15.

The upper surface of the upper cover 16 is equipped with a paper discharge section 13 to which sheets (recording media) after image formation are discharged. A paper discharge outlet 14 is disposed at the upper part of the main body housing 10 so as to face the paper discharge section 13 in a front and back direction. The paper discharge outlet 14 is an opening that communicates to the inside of the housing 10. Note that in the following description, the word "sheet" means a copy paper, a coated paper, an OHP sheet, a thick paper, a postcard, a tracing paper, or other sheet material on which an image formation process is performed.

The developing device 33 can be detached and attached via the main body opening part 15 in the state where the upper cover 16 is opened. Each of the image forming unit 30 and the fixing unit 40 (except the developing device 33) can be detached and attached via the back side of the main body housing 10 in the state where the back cover 12 is opened.

The paper feed unit 20 includes a sheet feed cassette 21. The sheet feed cassette 21 stores the sheets on which the image formation process is to be performed. A part of the sheet feed cassette 21 protrudes from the front of the main body housing 10 further to the front. An upper surface of a part of the sheet feed cassette 21 housed in the main body housing 10 is covered with a sheet teed cassette top lid 21U.

The sheet feed cassette 21 includes a sheet storing space for storing a bunch of sheets, a lift plate that lifts up the bunch of sheets for sheet feeding. A sheet feed section 21A is disposed at an upper part on the back end side of the sheet feed cassette 21. The sheet feed section 21A includes a sheet feed roller 21B for feeding the sheets in the sheet feed cassette 21 one by one from the top sheet.

The image forming unit 30 performs an image forming operation. The image forming operation is an operation for forming a toner image (a developer image) on the sheet fed from the paper feed unit 20. The image forming unit 30 includes a photosensitive drum 31, and a charging unit 32, an exposing unit 35, the developing device 33, and a transfer roller 34 that are disposed around the photosensitive drum 31. The developer that is used for image formation is a nonmagnetic one-component developer that contains only toner.

The photosensitive drum 31 (image carrying member) includes a rotation shall and an outer circumference surface that rotates about the rotation shaft. On the outer circumference surface of the photosensitive drum 31, there is formed a photosensitive layer, which is made of known organic photoconductor (OPC), for example, and includes a charge generation layer, a charge transport layer, and the like on the outer circumference surface. The photosensitive layer is uniformly charged by the charging unit 32 described above, is irradiated by a light beam from the exposing unit 35 so that an electrostatic latent image is formed with attenuated charge, and carries a toner image after the electrostatic latent image is visualized by the developing device 33.

Figure 3:
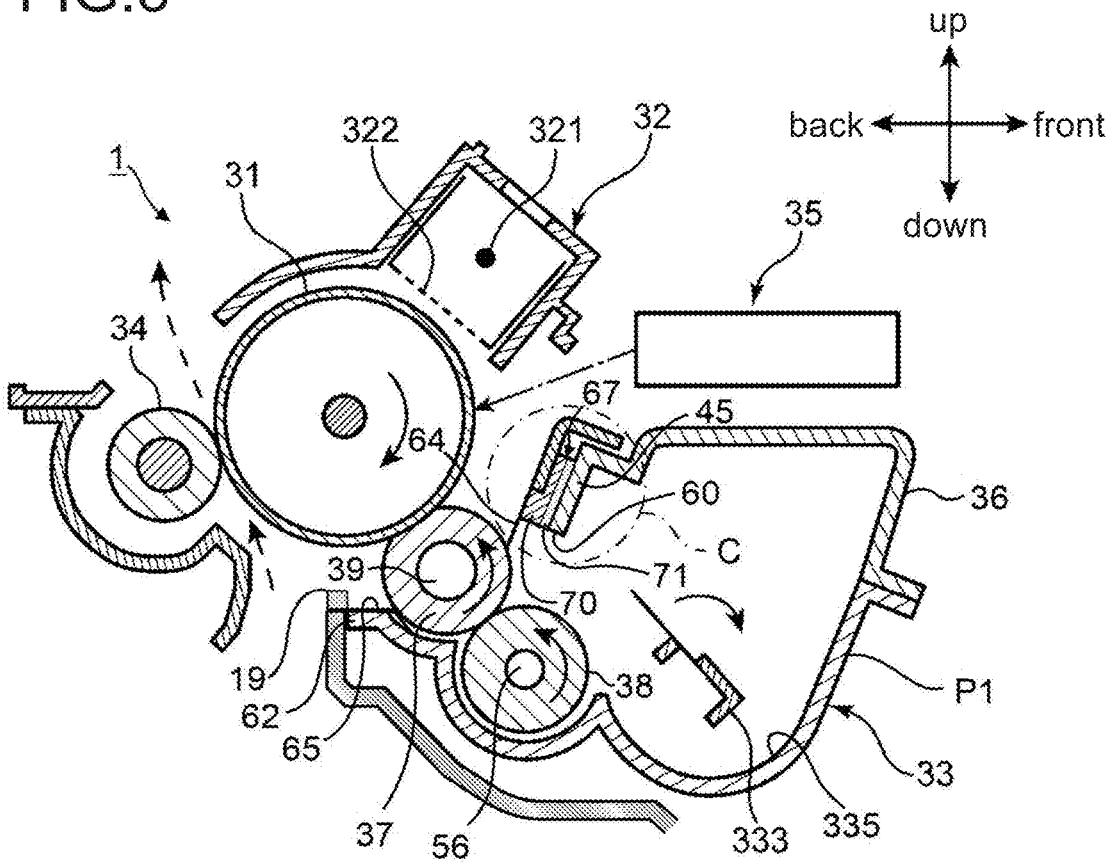
FIG. 3 is an enlarged cross-sectional view of a photosensitive drum, the developing device, and vicinity thereof.

The charging unit 32 (charging device) is disposed to face the outer circumference surface of the photosensitive drum 31 with a predetermined space therebetween, so as to uniformly charge the outer circumference surface of the photosensitive drum 31 in a noncontact manner. Specifically, the charging unit 32 includes a charging wire 321 and a grid electrode 322 (that are illustrated in FIG. 3). The charging wire 321 is a wire electrode extending in the rotation axis direction of the photosensitive drum 31, and generates corona discharge between itself and the photosensitive drum 31. The grid electrode 322 is a grid-like electrode extending in the rotation axis direction of the photosensitive drum 31, and is disposed between the charging wire 321 and the photosensitive drum 31.

The charging unit 32 supplies current of a predetermined current value to the charging wire 321 so as to generate the corona discharge, and supplies a predetermined voltage to the grid electrode 322 so as to uniformly charge the outer circumference surface of the photosensitive drum 31 facing the grid electrode 322 at a predetermined surface potential.

The exposing unit 35 (exposing device) includes a laser light source and optical equipment such as a mirror and a lens. The exposing unit 35 irradiates the outer circumference surface of the photosensitive drum 31 with the light beam modulated based on image data given from an external device such as a personal computer. In this way, the exposing unit 35 forms an electrostatic latent image corresponding to the image based on the image data on the outer circumference surface of the photosensitive drum 31.

The transfer roller 34 includes a rotation shaft parallel to a sheet width direction, and an outer circumference surface facing the outer circumference surface of the photosensitive drum 31. The transfer roller 34 is supported by the main body housing 10 in a rotatable manner about the rotation shaft. The transfer roller 34 transfers the toner image carried on the outer circumference surface of the photosensitive drum 31 to the sheet that passes through a nip between itself and the outer circumference surface of the photosensitive drum 31. For this transferring process, the transfer roller 34 is applied with a transfer voltage of an opposite polarity to the toner.

The fixing unit 40 is disposed on the downstream of the transfer roller 34 in the sheet conveying direction, so as to fix the transferred toner image on the sheet to the sheet. The fixing unit 40 includes a fixing roller 41 and a pressure roller 42. The fixing roller 41 has a heat source inside, so as to heat the transferred toner on the sheet to a predetermined temperature. The pressure roller 42 is pressed in contact with the fixing roller 41, so as to form a fixing nip between itself and the fixing roller 41. When the sheet with the transferred toner image passes through the fixing nip, the toner image is heated by the fixing roller 41 and pressed by the pressure roller 42, so as to be fixed onto the sheet.

Inside the main body housing 10, there are a main conveying path 22F and a reverse conveying path 22B. The main conveying path 22F and the reverse conveying path 22B convey the sheet. The main conveying path 22F extends from the sheet feed section 21A of the paper feed unit 20 through the image forming unit 30 and the fixing unit 40 to the paper discharge outlet 14. The reverse conveying path 22B is a conveying path used when duplex printing is performed on the sheet, so as to convey the sheet after being printed on one side back to the upstream side of the image forming unit 30 in the main conveying path 22F.

The main conveying path 22F extends to pass through the transfer nip between the photosensitive drum 31 and the transfer roller 34 from down to up. In addition, a registration roller pair 23 is disposed on the upstream side of the transfer nip in the main conveying path 22F. The sheet is temporarily stopped by the registration roller pair 23, and skew correction is performed. Then, the sheet is sent out to the transfer nip at a predetermined timing for image transfer. A plurality of conveying rollers for conveying the sheet are disposed in the main conveying path 22F and the reverse conveying path 22B. A sheet discharge roller pair 24 is disposed near the paper discharge outlet 14.

The reverse conveying path 22B is formed between an outer side surface of a reverse unit 25 and an inner surface of the back cover 12 of the main body housing 10. Note that an inner side surface of the reverse unit 25 is equipped with the transfer roller 34 and one roller of the registration roller pair 23. Each of the back cover 12 and the reverse unit 25 can rotate about an axis of a support part 121 disposed at lower ends thereof. If a jamming (sheet jamming) occurs in the reverse conveying path 22B, the back cover 12 is opened. If a jamming occurs in the main conveying path 22F, or when detaching a unit of the photosensitive drum 31 or the developing device 33 externally, not only the back cover 12 but also the reverse unit 25 is opened.

As illustrated in FIG. 1, guide rails 18 are formed on a pair of side surfaces 17 facing each other in the sheet width direction (in the direction perpendicular to the paper in FIG. 1) in the main body housing 10. The guide rail 18 has a rail structure recessed in the sheet width direction. The guide rail 18 extends downward from the main body opening part 15 to a mounting position P1 of the developing device 33 in the main body housing 10.

Figure 2:
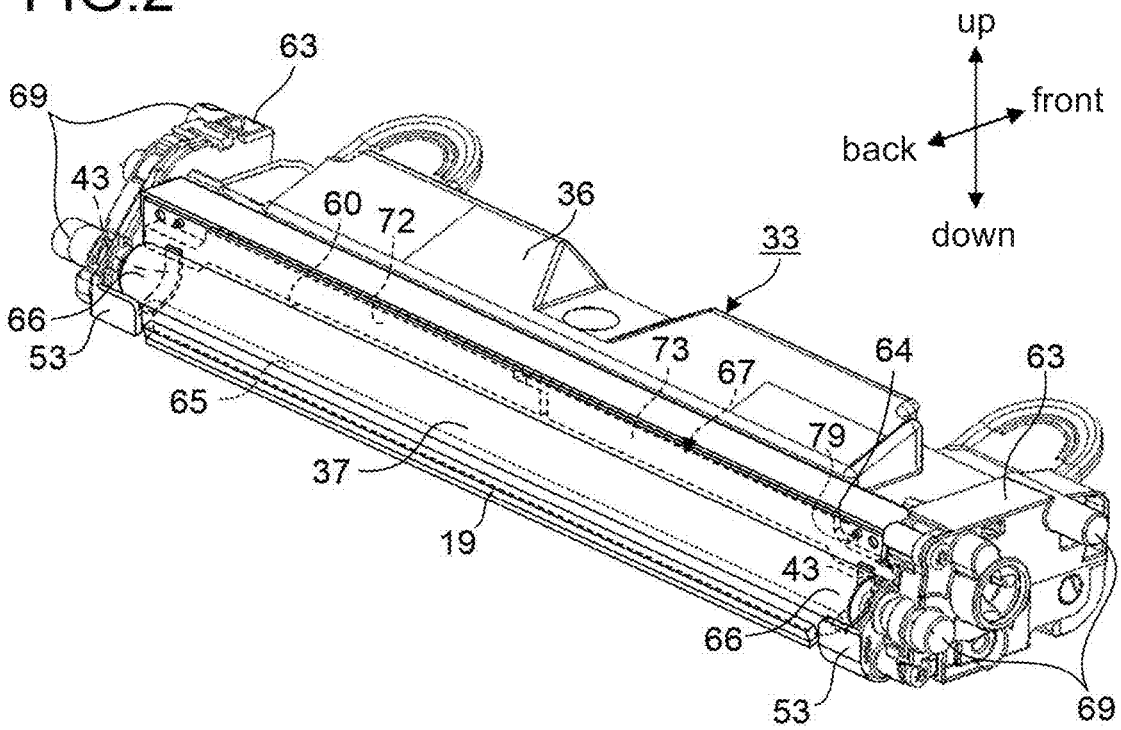
FIG. 2 is a perspective view illustrating the entire developing device.
Figure 4:
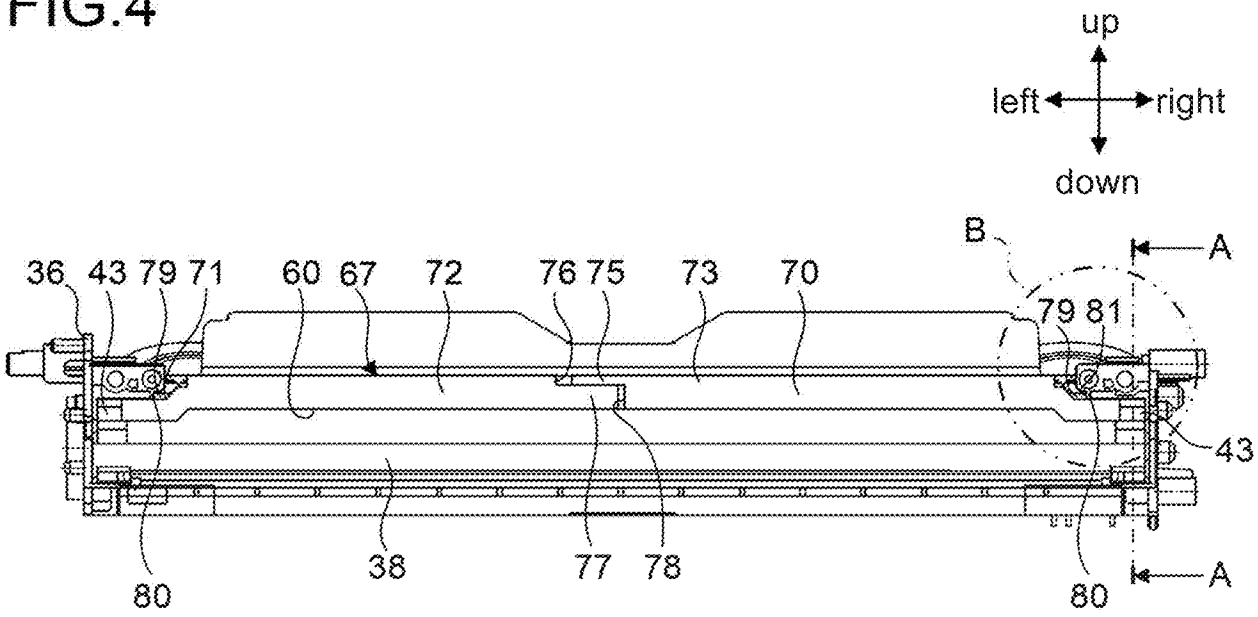
FIG. 4 is a plan view illustrating the developing device in a state where a developing roller, a regulating blade, and a bush cover are detached from a development casing.

FIG. 2 is a perspective view illustrating the entire developing device 33. FIG. 3 is an enlarged cross-sectional view of the photosensitive drum 31, the developing device 33, and vicinity thereof. FIG. 4 is a plan view of the developing device 33 in a state where a developing roller 37 (see FIG. 2), a regulating blade 64 (see FIG. 2), and bush covers 63 (see FIG. 2) are detached from a development casing 36.

As illustrated in FIGS. 2, 3, and 4, the developing device 33 includes the development casing 36, the developing roller 37 (developer carrying member), a supply roller 38, a stirring paddle 333, and guide sections 69.

The development casing 36 accommodates nonmagnetic one-component developer containing only toner, and includes the developing roller 37, the supply roller 38, and the like. The development casing 36 has a stirring chamber 335, a case opening part 60 (opening part), and the bush covers 63. The stirring chamber 335 accommodates stirred developer.

The case opening part 60 is positioned on the back side of the stirring chamber 335 in the front and back direction. The case opening part 60 is a rectangular shaped through hole that opens on the back side of the development casing 36 (on the side close to the photosensitive drum 31). The case opening part 60 is formed to be elongated in the width direction (axis direction) of the developing device 33.

The developing roller 37 is disposed inside the case opening part 60 so as to overlap the case opening part 60. A part of the outer circumference surface of the developing roller 37 is exposed to the outside of the development casing 36 from the case opening part 60. The developing roller 37 includes a rotation shaft 39 extending along the width direction of the developing device 33 (the sheet width direction). The rotation shaft 39 is supported by the development casing 36 in a rotatable manner. In other words, the developing roller 37 is supported by the development casing 36 via the rotation shaft 39 in a rotatable manner about the rotation shaft 39 in a counterclockwise direction in the diagram (see FIG. 3). In the following description, the direction along the rotation shaft 39 is referred to as the "axis direction (rotation axis direction)". In addition, a rotation direction of the developing roller 37 about the rotation shaft 39 is referred to as a "rotation direction".

The developing roller 37 can carry the toner on the outer circumference surface. When the developing device 33 is in the mounting position P1, the exposed part of the developing roller 37 exposed from the case opening part 60 is in contact with or close to the outer circumference of the surface photosensitive drum 31. In this state, the developing roller 37 can supply the nonmagnetic one-component toner (developer) to the photosensitive drum 31.

The supply roller 38 is disposed between the developing roller 37 and the stirring paddle 333. The supply roller 38 supplies the nonmagnetic one-component toner (developer) to the outer circumference surface of the developing roller 37. The stirring paddle 333 is disposed in the stirring chamber 335 so as to stir the developer in the stirring chamber 335.

The bush covers 63 are attached to both end parts of the development casing 36 in the sheet width direction in an attachable and detachable manner. The bush cover 63 forms a side wall part of the development casing 36. The bush cover 63 is provided with a plurality of through holes penetrating in the axis direction, and the rotation shaft 39 of the developing roller 37 and the rotation shaft of the supply roller 38 are inserted in the through holes, so that the developing roller 37 and the supply roller 38 are supported in a rotatable manner.

The guide sections 69 are cylindrical protrusions protruding from the bush cover 63. The guide section 69 can engage with the guide rail 18. The developing device 33 can move between the main body opening part 15 and the mounting position P1 along the guide rail 18 with engagement between the guide rail 18 and the guide sections 69.

The developing device 33 is mounted at the mounting position P1 in the main body housing 10, and in this state it supplies the toner to the outer circumference surface of the photosensitive drum 31. In this way, the electrostatic latent image formed on the outer circumference surface of the photosensitive drum 31 is developed (the electrostatic latent image is visualized to be a toner image (visual image)).

As illustrated in FIGS. 2 and 4, pressing members 43, a flat part 62, a front seal member 65, the regulating blade 64, and a blade seal member 67 are disposed in a periphery of the case opening part 60. The pressing members 43 are disposed at both end parts of the developing roller 37 in the axis direction. The flat part 62 is disposed on the back side of the case opening part 60 (at a position closer to the photosensitive drum 31). The front seal member 65 is disposed on the flat part 62. The regulating blade 64 is fixed to the back side end part of the development casing 36. The blade seal member 67 is laminated on a back surface side of the regulating blade 64.

Figure 5:
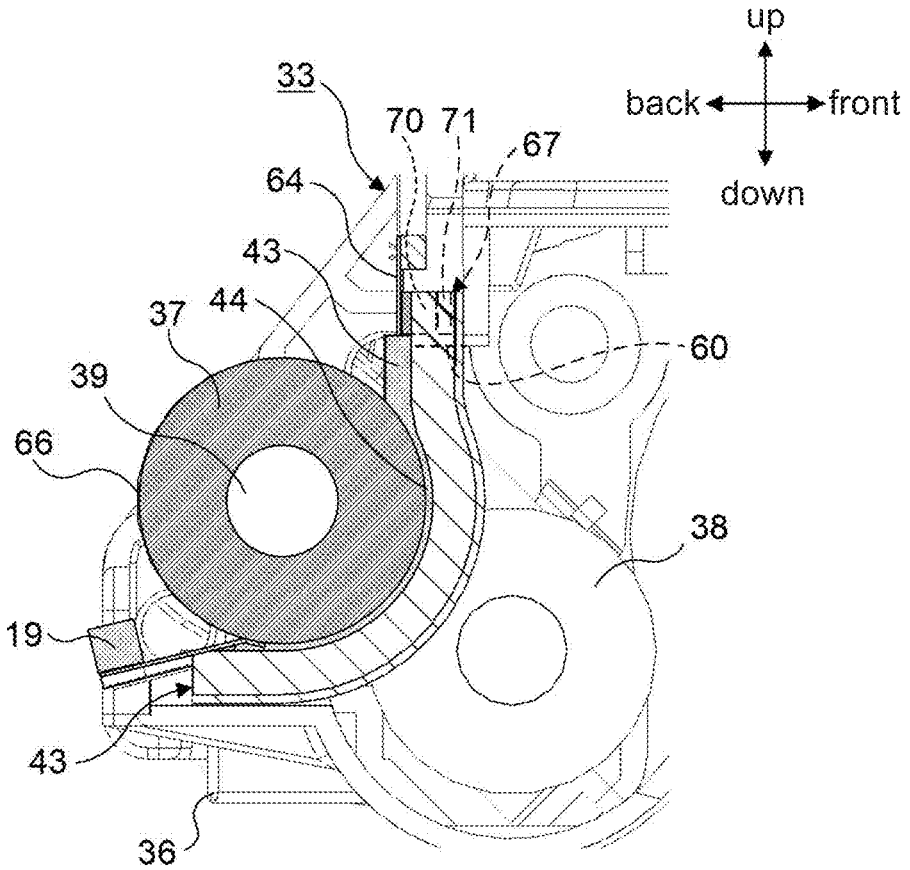
FIG. 5 is a cross-sectional side view of the developing device taken along the A-A line in FIG. 4.
Figure 6:
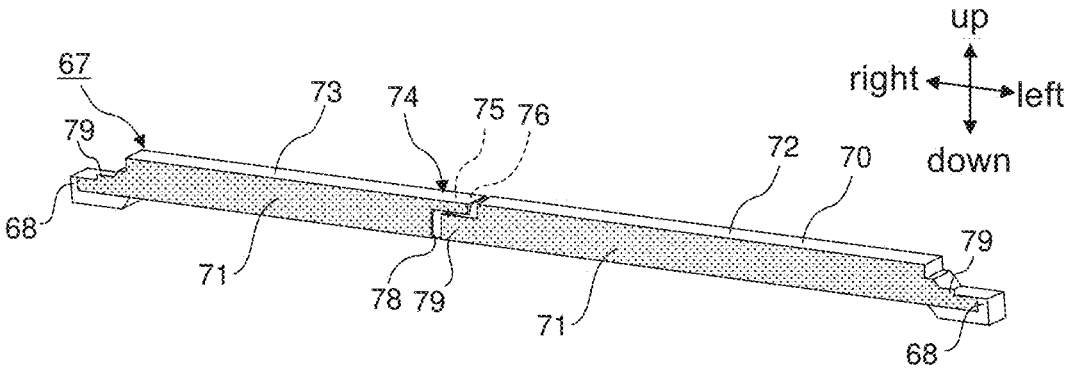
FIG. 6 is a perspective view illustrating a blade seal member.

FIG. 5 is a cross-sectional side view of the developing device 33 taken along the A-A line in FIG. 4. FIG. 6 is a perspective view illustrating the blade seal member 67. FIG.

7 is a partial enlarged view of an end part of the blade seal member 67 and its vicinity of the developing device 33 (of the area enclosed by the two dots dashed line circle B in FIG. 4). Note that the blade seal member 67 illustrated in FIG. 6 is an inverted one of the blade seal member 67 illustrated in FIG. 4 in the front and back direction, i.e., left and right are reversed between FIG. 4 and FIG. 6.

The pressing member 43 is positioned to overlap each end part of the case opening part 60 in the axis direction (see FIG. 2). As illustrated in FIG. 5, the pressing member 43 has a pressing surface 44. The pressing surface 44 is a curved surface concave toward the front side (side of the stirring chamber 335) along the outer circumference surface of the developing roller 37. The pressing surface 44 faces the outer circumference surface of the developing roller 37 at both end parts 66 in a radial direction of the developing roller 37.

The thickness of the pressing member 43 is larger than the gap between the outer circumference surface of the developing roller 37 and the inner surface of the development casing 36. In this way, when the developing roller 37 is attached to the development casing 36, the pressing surface 44 contacts with the outer circumference surface of the developing roller 37 so as to press the developing roller 37 in its radial direction. As the pressing surface 44 contacts and presses the both end parts 66, the gaps between the development casing 36 and the both end parts 66 are sealed, so that the developer can be prevented from leaking out of the development casing 36.

The pressing member 43 has a multi-layered structure in which a plurality of (e.g., two) sheet members are laminated in the radial direction of the developing roller 37. Among the multi-layered sheet members, at least the sheet member closest the developing roller 37 in the radial direction is made of polytetrafluoroethylene (so-called Teflon). This sheet member has the pressing surface 44 described above formed on the surface. Among the multi-layered sheet members, other sheet members are made of urethane foam such as sponge.

With reference to FIGS. 2 and 3 again, the flat part 62 is a flat surface connecting to a part of the inner surface of the development casing 36 positioned below the developing roller 37. The flat part 62 extends from the case opening part 60 to the back side (the side close to the photosensitive drum 31). When the developing device 33 is in the mounting position P1, the flat part 62 is substantially horizontal.

The front seal member 65 is a rectangular sheet made of PET film or the like. The front seal member 65 is laminated on the flat part 62 and is glued to the development casing 36 with adhesive or the like. The front seal member 65 is elongated in the axis direction. The front seal member 65 extends along the axis direction between the both end parts 66 of the developing roller 37.

Among both end edges in the front and back direction (the direction perpendicular to the sheet width direction) of the front seal member 65, the end edge close to the developing roller 37 (supply roller 38) contacts with the entire developer carrying area in the outer circumference surface of the developing roller 37 in the axis direction. The front seal member 65 contacts with the outer circumference surface of the developing roller 37 and hence seals the gap between the development casing 36 and the developing roller 37 so as to prevent leakage of the developer in the development casing 36.

The front seal member 65 has a first shielding part 19. The first shielding part 19 rises from the end edge on the distant side from the developing roller 37 (supply roller 38), among both end edges in the front and back direction (the direction perpendicular to the sheet width direction), in a direction perpendicular to a surface of the front seal member 65. The first shielding part 19 protrudes upward in the entire area in the axis direction of the end edge of the front seal member 65. The first shielding part 19 is made of sponge or the like having a square shape. The first shielding part 19 is glued to the surface of the front seal member 65 with adhesive or the like. The first shielding part 19 retains the developer that slightly leaks from the gap between the developing roller 37 and the development casing 36 so that the developer does not drop to the outside of the developing device 33.

Outside the both end parts in the axis direction of the first shielding part 19, plate-like second shielding parts 53 are disposed so as to protrude upward. The second shielding part 53 is positioned to overlap the pressing member 43 in the axis direction. The second shielding part 53 is formed integrally to the bush cover 63. When the bush cover 63 is attached to the development casing 36, the second shielding part 53 extends to approach the first shielding part 19 from the bush cover 63 along the axis direction.

Figure 8:
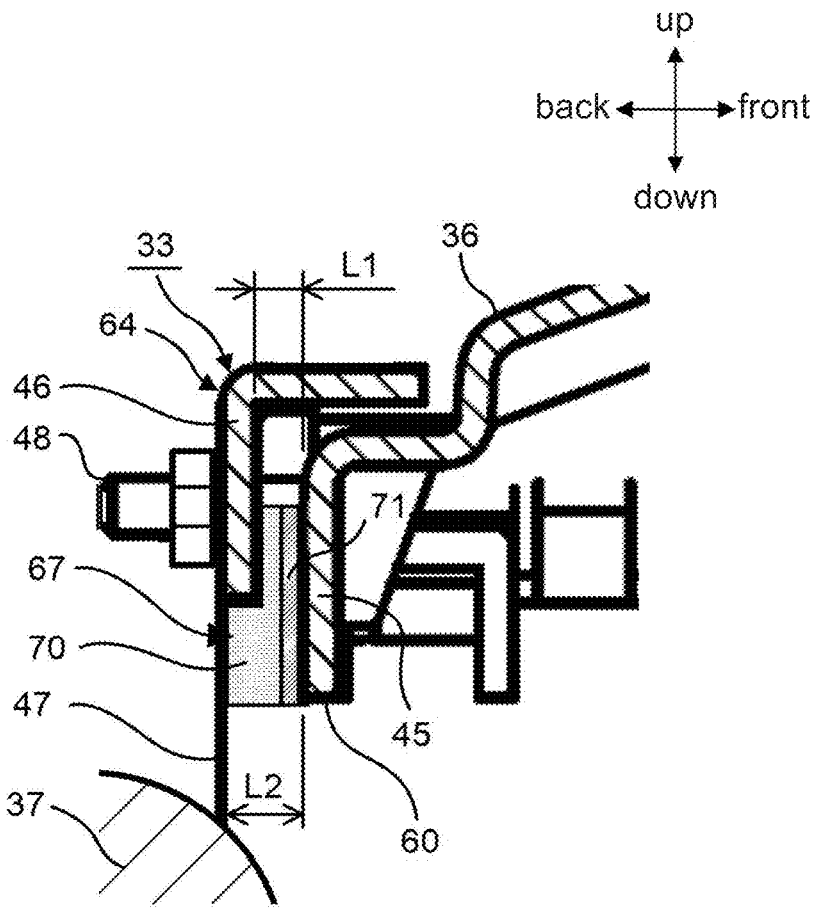
FIG. 8 is a partial enlarged view of a cross section of the regulating blade and its vicinity.

FIG. 8 is a partial enlarged view of a cross section of the regulating blade 64 and its vicinity (the area enclosed by the two dots dashed line circle C FIG. 3).

As illustrated in FIG. 8, the development casing 36 has a blade facing part 45. The blade facing part 45 is disposed at a part above an opening edge of the case opening part 60. The blade facing part 45 faces an upstream side surface of the regulating blade 64 in the rotation direction (a front surface in the front and back direction). The blade facing part 45 is formed flat in the axis direction.

The regulating blade 64 is a rectangular plate elongated in the axis direction (see FIG. 2). The regulating blade 64 is configured to include a fixed part 46 and a regulating part 47. The fixed part 46 is a metal plate-like member having a substantially right angle bent part to form an L shape viewed from the side. The fixed part 46 is disposed to face the blade facing part 45 in the rotation direction.

The regulating part 47 is a rectangular metal plate-like member elongated in the axis direction. An upper end part of the regulating part 47 is laminated and welded to a surface of the fixed part 46 on the downstream side in the rotation direction (on the side of the photosensitive drum 31). The regulating part 47 protrudes toward the developing roller 37 from a lower end part of the fixed part 46 (an end part of the fixed part 46 closest to the developing roller 37 in the up and down direction).

A distal end part in the protruding direction of the regulating part 47 is disposed to contact the outer circumference surface of the developing roller 37. The toner supplied onto the developing roller 37 enters between the regulating part 47 and the developing roller 37 when the developing roller 37 rotates, is charged by friction, and is carried as a thin layer of a constant thickness on the developing roller 37.

As illustrated in FIG. 8, a thickness of the regulating part 47 (a dimension in the front and back direction in FIG. 8) is thinner than that of the fixed part 46. In other words, a space L2 in the thickness direction between the regulating part 47 and the blade facing part 45 is larger than a space L1 in the thickness direction between the fixed part 46 and the blade facing part 45.

At the laminating part of the fixed part 46 and the regulating part 47 of the regulating blade 64, there is formed a through hole that penetrates the fixed part 46 and the regulating part 47 in a direction perpendicular to a surface of the fixed part 46 (in a thickness direction). The fixed part 46 is fixed to the blade facing part 45 with a fastening member 48 including a bolt penetrating the through hole and a nut.

As illustrated in FIG. 8, the blade seal member 67 is disposed between the regulating blade 64 and the development casing 36 in the rotation direction (the direction perpendicular to the axis direction). The blade seal member 67 is disposed between the pair of pressing members 43 in the axis direction (see FIG. 4). The blade seal member 67 is constituted of a multi-layered sheet including a first layer material 70 and a second layer material 71 that are laminated in the front and back direction.

The first layer material 70 is made of sponge such as PORON in a rectangular shape. The first layer material 70 is elongated in the axis direction. Both end parts in the axis direction of the first layer material 70 are pressed in contact with (contact and press) the pressing members 43. (see FIG. 4). The first layer material 70 is laminated on surfaces of the fixed part 46 and the regulating part 47 on the side distant from the photosensitive drum 31 (on surfaces on the upstream side in the rotation direction of the developing roller 37). A double sided tape having adhesive on both sides is attached on a surface of the first layer material 70 on the downstream side in the rotation direction (on the back side in the front and back direction). In other words, the double sided tape is disposed between the first layer material 70 and the regulating part 47. With this double sided tape, the first layer material 70 is glued to the regulating part 47.

The first layer material 70 is pressed and compressed by the fixed part 46 and the regulating part 47 to the blade facing part 45. A compression amount of the first layer material 70 at a part between the fixed part 46 and the blade facing part 45 is larger than a compression amount of the first layer material 70 at a part between the regulating part 47 and the blade facing part 45.

The first layer material 70 is formed so that a dimension in the up and down direction is larger than a dimension in the thickness direction (the front and back direction), before and after it is disposed (compressed) between the regulating blade 64 and the blade facing part 45. In other words, a cross section of the first layer material 70 perpendicular to the axis direction is elongated in the up and down direction.

As illustrated in FIGS. 4 and 6, the first layer material 70 is constituted of a first seal member 72 and a second seal member 73 that are aligned in the axis direction. A connection part 74 is formed in an opposing part of the first seal member 72 and the second seal member 73.

The first seal member 72 is provided with a first protrusion 75 and a first recess 76. The first protrusion 75 and the first recess 76 are positioned at the end part that is positioned at the middle of the case opening part 60 in the axis direction. The first protrusion 75 protrudes from the end part of the first seal member 72 in the axis direction. The first recess 76 sinks from the tip in the protruding direction of the first protrusion 75 in an opposite direction to the protruding direction. The first protrusion 75 and the first recess 76 are adjacent to each other in the direction perpendicular to the axis direction.

The second seal member 73 is provided with a second protrusion 77 and a second recess 78. The second protrusion 77 and the second recess 78 are positioned at the end part that is positioned at the middle of the case opening part 60 in the axis direction. The second protrusion 77 protrudes from the end part of the second seal member 73 in the axis direction. The second recess 78 sinks from the tip in the protruding direction of the second protrusion 77 in an opposite direction to the protruding direction. The second protrusion 77 and the second recess 78 are adjacent to each other in the direction perpendicular to the axis direction.

The second protrusion 77 overlaps the first recess 76 in the direction perpendicular to the axis direction (in the up and down direction). The length from the bottom of the second recess 78 to the tip of the second protrusion 77 is equal to or slightly less than the length from the bottom of the first recess 76 to the tip of the first protrusion 75. The first protrusion 75 is inserted in the second recess 78, and the second protrusion 77 is inserted in the first recess 76.

The connection part 74 is constituted of the first protrusion 75, the first recess 76, the second protrusion 77, and the second recess 78. The connection part 74 bonds the first seal member 72 and the second seal member 73 in the axis direction, using adhesive applied to seal the gap between the first protrusion 75 and the second recess 78, and the gap between the first recess 76 and the second protrusion 77.

The second layer material 71 is a sheet member elongated in the axis direction. The second layer material 71 is made of polyethylene terephthalate (PET). The second layer material 71 has a larger stiffness than the first layer material 70. As illustrated in FIGS. 5 and 6, the second layer material 71 is laminated on the surface of the first layer material 70 opposite to the contact surface with the regulating blade 64 (the surface on the distant side from the developing roller 37 in the front and back direction). The second layer material 71 is glued to the first layer material 70 with adhesive or the like. The second layer material 71 is laminated on each of the first seal member 72 and the second seal member 73.

The length in the axis direction of the second layer material 71 is shorter than the length in the axis direction of the blade seal member 67. The both end parts of the second layer material 71 are positioned inside the both end parts of the blade seal member 67 in the axis direction. In the areas from the both end parts of the blade seal member 67 to the both end parts of the second layer material 71 in the axis direction, there are formed cushion parts 68 in which the first layer material 70 protrudes from the second layer material 71.

The second layer materials 71 are provided respectively with seal side positioning protrusions 79 (positioning protrusions) at symmetric positions in the axis direction inside the both end parts in the axis direction. The seal side positioning protrusion 79 protrudes outward from an edge part of the blade seal member 67 in the axis direction and in the up and down direction (see FIG. 7).

Figure 7:
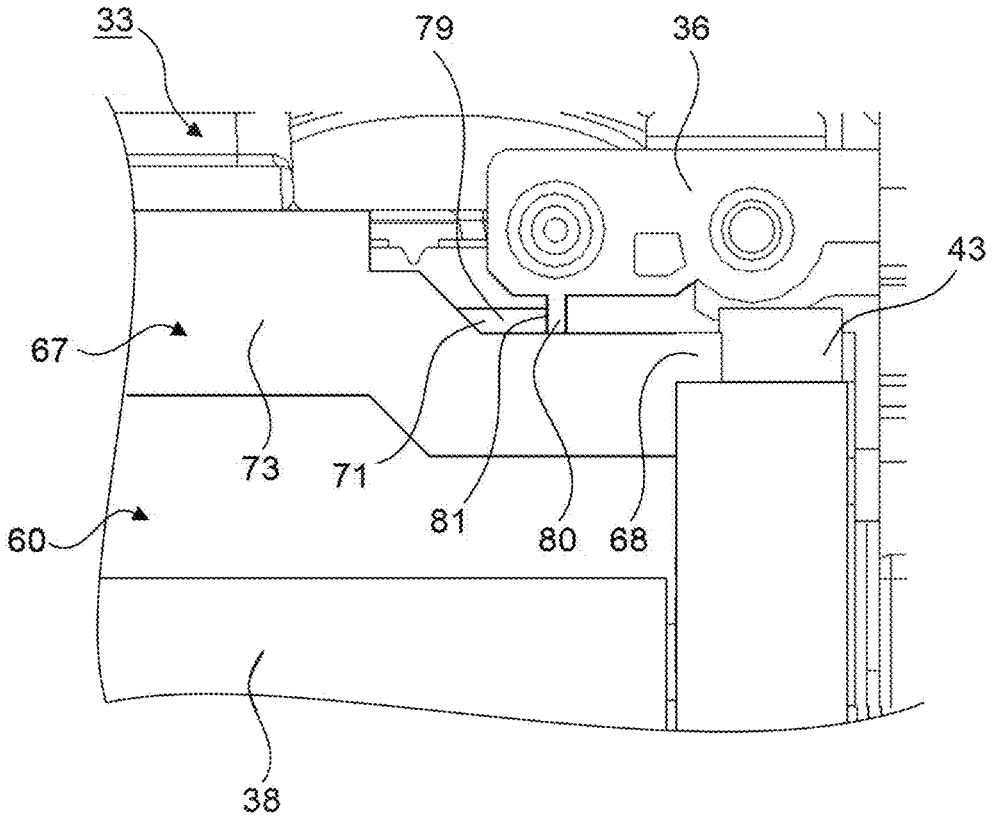
FIG. 7 is a partial enlarged view of an end part of the blade seal member and its vicinity of the developing device.

As illustrated in FIGS. 4 and 7, case side positioning protrusions 80 are formed respectively on the both end parts in the axis direction of the case opening part 60. The case side positioning protrusion 80 protrudes downward from a part of the inside of the development casing 36. Facing surfaces 81 are formed on the surfaces of the case side positioning protrusions 80 that are close to the middle in the axis direction of the case opening part 60. The facing surfaces 81 of the case side positioning protrusions 80 face each other in the axis direction sandwiching a part of the blade seal member 67 therebetween.

The seal side positioning protrusions 79 are positioned inside the case side positioning protrusions 80 in the axis direction. The seal side positioning protrusion 79 and the case side positioning protrusion 80 are positioned to overlap each other in the up and down direction. The seal side positioning protrusion 79 faces the case side positioning protrusion 80 in the axis direction. As the seal side positioning protrusion 79 contacts with the case side positioning protrusion 80, the second layer material 71 is positioned in the axis direction.

As described above, the first layer material 70 is glued to the regulating part 47. Therefore, even if the regulating blade 64 is slightly inclined, a gap is hardly generated between the regulating part 47 and the first layer material 70, and hence leakage of the developer can be prevented.

In addition, as described above, the compression amount of the first layer material 70 at the part between the fixed part 46 and the blade facing part 45 is larger than the compression amount of the first layer material 70 at the part between the regulating part 47 and the blade facing part 45. In other words, the resilience of the first layer material 70 at the part between the regulating part 47 and the blade facing part 45 is smaller than that between the fixed part 46 and the blade facing part 45. However, the first layer material 70 is glued to the regulating part 47, and hence a gap is hardly generated between the first layer material 70 and the regulating part 47. Therefore, the developer hardly leaks from the development casing 36.

Therefore, it is possible to provide the developing device 33 that can prevent leakage of the developer while appropriately controlling the layer thickness of the developer on the developing roller 37.

In addition, the first layer material 70 is formed so that the dimension of the compressed first layer material 70 in the up and down direction is larger than the dimension in the thickness direction, and is laminated on the fixed part 46 and the regulating part 47. In other words, the first layer material 70 contacts the regulating blade 64 in a relatively large area in the up and down direction. Then, a pressing force of the regulating blade 64 to the blade facing part 45 can be reduced to such a degree that the regulating blade 64 is stabilized, and hence inclination of the regulating blade 64 can be suppressed. Therefore, leakage of the developer can be prevented more appropriately, and it can be avoided that layer thickness of the developer on the developing roller 37 cannot be appropriately controlled due to inclination of the regulating blade 64.

In addition, as described above, stiffness of the second layer material 71 is larger than stiffness of the first layer material 70. Therefore, when the second layer material 71 is glued to the first layer material 70, the second layer material 71 hardly generates wrinkles or bends, and a gap is hardly generated between the second layer material 71 and the development casing 36 (the blade facing part 45).

Further, as the second layer material 71 having a relatively large stiffness is laminated and glued to the first layer material 70, the first layer material 70 is hardly bent thanks to a support of the second layer material 71. Therefore, when the first layer material 70 is glued to the regulating blade 64 (the fixed part 46 and the regulating part 47), it is possible to prevent the bonded surface of the first layer material 70 to the regulating part 47 from generating wrinkles or bends. Therefore, a gap is hardly generated between the first layer material 70 and the regulating part 47, and leakage of the developer can be prevented more appropriately.

In addition, as described above, as the seal side positioning protrusion 79 and the facing surfaces 81 contact with each other, the second layer material 71 is positioned. The second layer material 71 has a larger stiffness than the first layer material 70, and hence the blade seal member 67 can be positioned easily by contact between the seal side positioning protrusion 79 and the facing surfaces 81. Here, the second layer material 71 is laminated and glued to the first layer material 70, and when the second layer material 71 is positioned, the first layer material 70, i.e. the blade seal member 67 is positioned. In this state, the first layer material 70 is pressed in contact with the pressing member 43, and hence a gap between the development casing 36 and the blade seal member 67 in the axis direction is sealed with the pressing member 43, so that a developer leakage path can be blocked.

In addition, as described above, the both end parts of the second layer material 71 are positioned inside the both end parts of the first layer material 70 in the axis direction, and the cushion parts 68 are formed in the parts of the first layer material 70 from the both end parts of the second layer material 71 to the both end parts of the first layer material 70. Therefore, when the blade seal member 67 is positioned so that the both end parts of the first layer material 70 contact with the pressing members 43, the cushion parts 68 are compressed. Then, compressibility of the part of the first layer material 70 contacting with the pressing member 43 (the cushion part 68) is increased, and hence sealing property between the first layer material 70 and the pressing member 43 can be increased. Therefore, leakage of the developer can be prevented more appropriately.

In addition, as described above, the first layer material 70 is constituted of the first seal member 72 and the second seal member 73, which are separately formed and connected in the connection part 74. Further, the second layer material 71 is laminated on each of the first seal member 72 and the second seal member 73. Therefore, when disposing the blade seal member 67 between the pair of pressing members 43 in the axis direction, it can be disposed with a play (clearance) between each pressing member 43 and the first seal member 72 or the second seal member 73. In this state, the first seal member 72 and the second seal member 73 can be glued with adhesive with a space so that a predetermined contact pressure is generated between the blade seal member 67 and the pressing member 43. In this way, assemblability is improved, and manufacturing cost of the developing device 33 can be reduced.

Furthermore, the first shielding part 19 is disposed to protrude upward over the entire end edge in the longitudinal direction of the front seal member 65. Therefore, even if waste toner is accumulated around the case opening part 60, when the developing device 33 is attached to the main body housing 10 and faces down, the waste toner around the case opening part 60 is blocked by the first shielding part 19. Thus, the waste toner can be prevented from dropping into the main body housing 10.

Therefore, it is possible to provide the developing device 33, which can prevent the developer from leaking through the gap between the developing roller 37 and the development casing 36, and can prevent the developer from dropping from the periphery of the case opening part 60 of the developing device 33 into the main body housing 10.

In addition, as described above, the second shielding part 53 is positioned to overlap the pressing member 43 in the axis direction. Therefore, even if the developer slightly leaks from the gap between the pressing member 43 and the developing roller 37, the second shielding part 53 can prevent the developer from leaking outside of the development casing 36. In addition, as described above, the second shielding part 53 is formed integrally to the bush cover 63. Therefore, when the bush cover 63 is attached, the second shielding part 53 is also positioned at a predetermined position. Thus, man-hours in assembly can be reduced, and manufacturing cost can be reduced.

Other than that, the present disclosure is not limited to the embodiment described above but can be variously modified within the scope of the present disclosure without deviating from the spirit thereof. For instance, the monochrome printer is exemplified as the image forming apparatus 1 in the embodiment described above, but the present disclosure can also be applied to a tandem type or rotary type color printer. In addition, the present disclosure can also be applied to an image forming apparatus such as a copier, a facsimile machine, or a multifunction peripheral having functions thereof.

In addition, as described above, the first layer material 70 is glued to the regulating part 47, but it may be glued to the fixed part 46, too.

In addition, it may be possible to adopt a structure in which the blade seal member 67 is constituted of only the first layer material 70 without the second layer material 71. In this case, it may be possible to adopt a structure in which a surface of the first layer material 70 opposite to the blade seal member 67 is glued to the blade facing part 45.

In addition, the first shielding part 19 is made of sponge in the embodiment described above, but without limiting to this, it can be made of other material. In addition, the first shielding part 19 may have a structure in which it is formed integrally to the front seal member 65 and is bent to rise up from the end edge of the front seal member 65. In this case, the number of components of the front seal member 65 is reduced so that manufacturing cost can be reduced.

In addition, the developer is nonmagnetic one-component developer containing only toner in the embodiment described above, but it may be possible to adopt two-component developer containing toner and carrier.

The present disclosure can be applied to image forming apparatuses including a developing device that performs development using developer containing toner. Using the present disclosure, it is possible to provide an image forming apparatus that can prevent leakage of developer.

What is claimed is:

1. A developing device comprising:

a development casing configured to have an opening part and to accommodate developer containing toner;

a developer carrying member supported by the development casing in a rotatable manner, the developer carrying member having a developing area in which a part of an outer circumference surface for carrying the developer is exposed through the opening part and faces an image carrying member, so that the toner is supplied to the image carrying member in the developing area; and a regulating blade disposed on an upstream side of the developing area in a rotation direction of the developer carrying member, so as to regulate a layer thickness of the developer carried by the developer carrying member, wherein the development casing has a blade facing part that faces an upstream side surface of the regulating blade in the rotation direction, the regulating blade includes a fixed part that faces the blade facing part and is fixed to the development casing, and a regulating part that protrudes from the fixed part toward the developer carrying member, and a space between the regulating part and the blade facing part is larger than a space between the fixed part and the blade facing part, and the developing device further comprises a blade seal member that is disposed between the regulating blade and the blade facing part, and is glued to an upstream side surface of the regulating part in the rotation direction, so as to seal a gap between the regulating blade and the blade facing part.

2. The developing device according to claim 1, wherein the blade seal member includes a first layer material laminated on a surface facing the regulating blade, and a second layer material laminated on a surface of the first layer material opposite to the regulating blade, the second layer material having a larger stiffness than the first layer material.

3. The developing device according to claim 2, wherein an upstream side surface of the second layer material in the rotation direction is glued to the blade facing part.

4. The developing device according to claim 2, wherein both end parts of the second layer material in a rotation axis direction of the developer carrying member are disposed inside of both end parts of the first layer material in the rotation axis direction.

5. The developing device according to claim 2, wherein the first layer material includes a first seal member, a second seal member aligned with the first seal member in a rotation axis direction of the developer carrying member, and a connection part formed in an opposing part of the first seal member and the second seal member, the connection part includes a first protrusion protruding in the rotation axis direction from an end part of the first seal member on the second seal member side in the rotation axis direction toward the second seal member, a first recess sinking from the end part of the first seal member in an opposite direction to the protruding direction of the first protrusion, a second protrusion protruding in the rotation axis direction from an end part of the second seal member on the first seal member side in the rotation axis direction so as to be inserted in the first recess, and a second recess sinking from the end part of the second seal member in an opposite direction to the protruding direction of the second protrusion so as to receive the first protrusion, and the first seal member and the second seal member are glued to each other with adhesive applied to at least a part of between the first protrusion and the second recess and between the first recess and the second protrusion, so that the adhesive seals a gap between the first seal member and the second seal member.

6. The developing device according to claim 2, Wherein the first layer material is sponge.

7. The developing device according to claim 2, Wherein the second layer material is a sheet member made of polyethylene terephthalate.

8. An image forming apparatus comprising:

an apparatus main body;

an image carrying member disposed in the apparatus main body so as to form an electrostatic latent image on an outer circumference surface; and the developing device according to claim 1 disposed in the apparatus main body in an attachable and detachable manner, so as to develop the electrostatic latent image into a toner image in a state of being disposed in the apparatus main body, with the developer carrying member contacting with or being close to an outer circumference surface of the image carrying member.

* * * * *